US006776309B2

(12) United States Patent
Schultz

(10) Patent No.: US 6,776,309 B2
(45) Date of Patent: Aug. 17, 2004

(54) MEDICALLY ACCURATE PUMP SYSTEM

(75) Inventor: Robert S. Schultz, Old Greenwich, CT (US)

(73) Assignee: Ben Z. Cohen, New York, NY (US)

( * ) Notice: Subject to any disclaimer, the term of this patent is extended or adjusted under 35 U.S.C. 154(b) by 0 days.

(21) Appl. No.: 10/476,369

(22) PCT Filed: May 14, 2003

(86) PCT No.: PCT/US03/15119

§ 371 (c)(1),
(2), (4) Date: Oct. 29, 2003

(87) PCT Pub. No.: WO03/099706

PCT Pub. Date: Dec. 4, 2003

(65) Prior Publication Data

US 2004/0129733 A1 Jul. 8, 2004

Related U.S. Application Data

(60) Provisional application No. 60/383,076, filed on May 23, 2002.

(51) Int. Cl.[7] ..... B67D 5/42

(52) U.S. Cl. ..... 222/321.1; 222/321.9; 222/386

(58) Field of Search ..... 222/321.1, 321.6, 222/321.7, 321.8, 321.9, 385, 386

(56) References Cited

U.S. PATENT DOCUMENTS 3,774,849 A 11/1973 Boris
4,051,983 A 10/1977 Anderson
4,230,242 A 10/1980 Meshberg
4,932,569 A * 6/1990 Ruscitti et al. ..... 222/402.24
5,277,559 A 1/1994 Schultz
5,649,649 A * 7/1997 Marelli ..... 222/321.2
6,126,038 A * 10/2000 Olegnowicz ..... 222/1
6,371,337 B2 4/2002 Garcia et al.

FOREIGN PATENT DOCUMENTS

WO WO 0114245 * 3/2004 ..... B67D/5/42

* cited by examiner

*Primary Examiner*—Gregory L. Huson
*Assistant Examiner*—Patrick Buechner
(74) *Attorney, Agent, or Firm*—Hoffman & Baron, LLP

(57) ABSTRACT

Pump systems are provided which allow for highly-accurate dose control. The pump systems may be provided with a valve stem or a piston, either having a constant-diameter stroke portion interposed between reduced-diameter portions. At least one stationary sealing member immovably affixed to a pump body is also provided formed to sealingly engage the stroke portion of the valve stem or the piston. The sealing member is also formed to not engage the reduced-diameter portions. As such, the volume of the administered dose is controlled by the stroke length, which, in turn, is a function of the dimensioning of the constant-diameter stroke portion and the dimensioning of the sealing member. Advantageously, with the subject invention, a minimal number of tolerances can be implicated in controlling dosing volume.

16 Claims, 6 Drawing Sheets

MEDICALLY ACCURATE PUMP SYSTEM

CROSS-REFERENCE TO RELATED APPLICATION

This application claims priority of U.S. Provisional Application No. 60/383,076, filed May 23, 2002.

FIELD OF THE INVENTION

This invention relates to pumps, and, more particularly, to pumps having highly-accurately controlled dosing.

Highly-accurate pumps are known in the prior art for repeatedly delivering doses within exacting tolerances, even at extremely low-dose volumes. For example, with reference to International Patent Application No. PCT/US00/23206, published as International Publication No. WO 01/14245 on Mar. 1, 2001, a pre-compression pump system is shown for repeatedly delivering microdoses of fluid. The pump of this design utilizes a stationary seal which bears against a moving valve stem. The stroke of the pump is defined by the length of a constant-diameter portion of the valve stem which terminates at a lower extreme defined by a plurality of circumferentially-spaced recesses. In this manner, the seal member remains in constant sealing engagement with the valve stem with fluid bypassing the sealing member via the recesses to re-charge the pump chamber. With this structural configuration, accurate control of dosing can be achieved through accurate dimensioning of the valve stem and recesses. In a different approach, U.S. Pat. No. 5,277,559, which issued on Jan. 11, 1994 to the inventor herein, a pump with a sliding seal is provided which moves, at least in part, with a valve stem that selectively controls flow through the pump.

SUMMARY OF THE INVENTION

With the subject invention, pump systems are provided which allow for highly-accurate dose control. In one embodiment, a pump system is provided which includes a pump body having a first chamber defined therein; a valve stem disposed to slide within at least a portion of the pump chamber, the valve stem having a constant-diameter stroke portion interposed between reduced-diameter portions; and at least one stationary sealing member immovably affixed to the pump body formed to sealingly engage the stroke portion of the valve stem. The sealing member is also formed to not engage the reduced-diameter portions of the valve stem. With the sealing member sealingly engaging the stroke portion of the valve stem, a portion of the first chamber of the pump body is isolated or substantially isolated from other portions of the chamber. Accordingly, fluid trapped within the first portion may be compressed and dispensed.

In a second embodiment, a pump system is provided which includes a pump body having a first chamber defined therein; a piston disposed to slide within at least a portion of the first chamber, the piston having a constant-diameter stroke portion interposed between reduced-diameter portions; and at least one stationary sealing member immovably affixed to the pump body formed to sealingly engage the stroke portion of the piston. The sealing member is also formed to not engage reduced-diameter portions of the piston. With the sealing member sealingly engaging the stroke portion, a portion of the first chamber is isolated or substantially isolated from other portions of the first chamber. Again, as with the first embodiment, fluid trapped within the first chamber can be pressurized in being dispensed.

With both embodiments, the volume of the administered dose is controlled by the stroke length, which, in turn, is a function of the dimensioning of the constant-diameter stroke portion and the dimensioning of the sealing member. Advantageously, with the subject invention, a minimal number of tolerances can be implicated in controlling dosing volume.

In third and fourth embodiments, "in-line" pump systems can be provided having an exit aperture extending along the longitudinal axis of the pump system (such as in the manner of a nasal spray). These embodiments each include a valve stem and operate in the same basic manner as the first embodiment.

These and other features will be better understood through a study of the following detailed description and accompanying drawings.

BRIEF DESCRIPTION OF DRAWINGS

FIGS. 11A–11C are top, side and bottom views, respectively of a swirl plug which may be utilized in connection with the subject invention.

DETAILED DESCRIPTION

Pump systems are described herein having a relatively low number of dimensions critical for controlling dosing. The pump systems are particularly well-suited for use with ophthalmic medication, which can be repeatedly and accurately dosed in relatively small doses (less than or equal to 50 microliters). In manufacturing, a low number of critical dimensions translates to a small range of net inaccuracy (e.g., combined deviations within acceptable tolerances).

Figure 1:
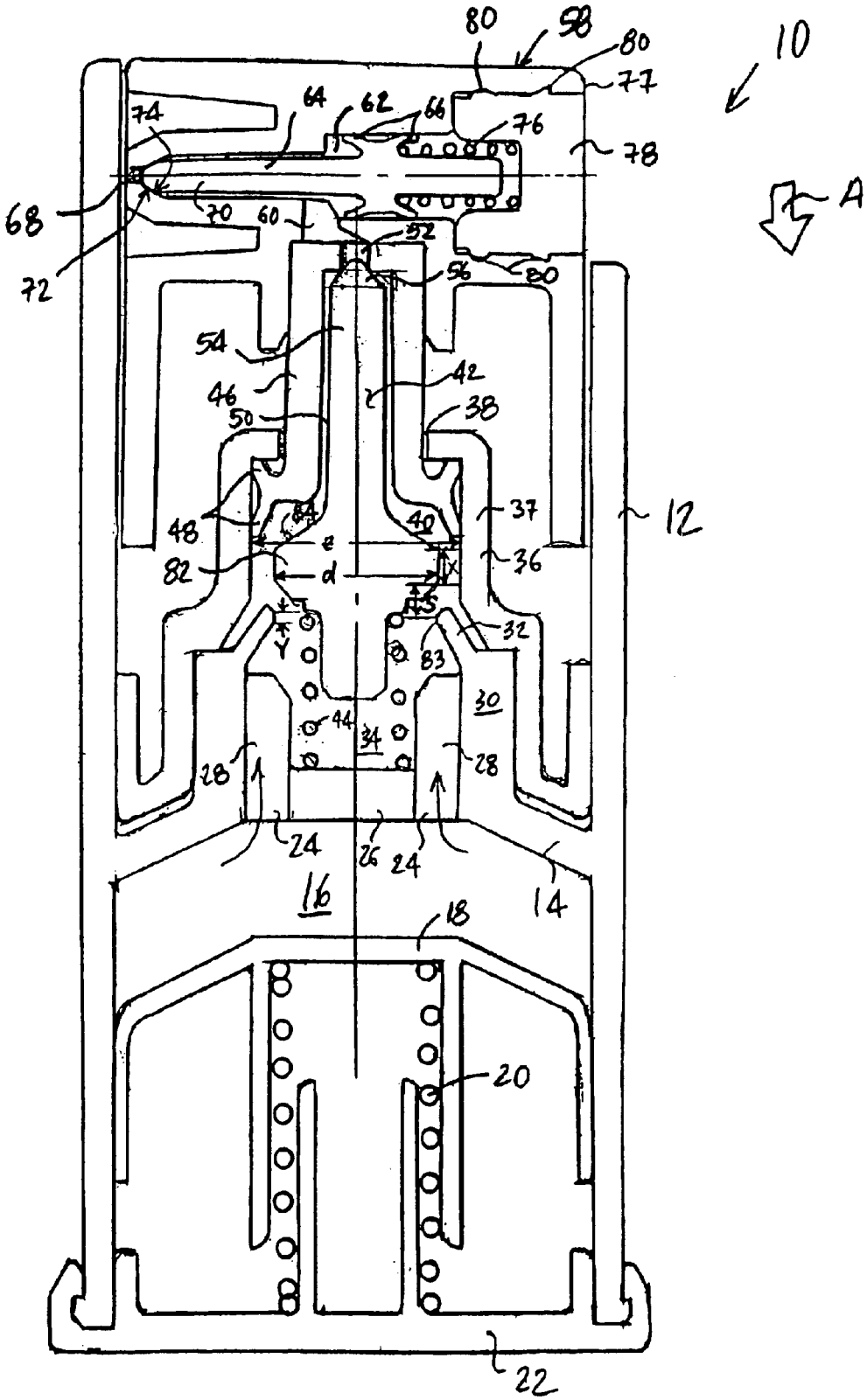
FIGS. 1–3 depict a first embodiment of a pump system formed in accordance with the subject invention herein.
Figure 2:
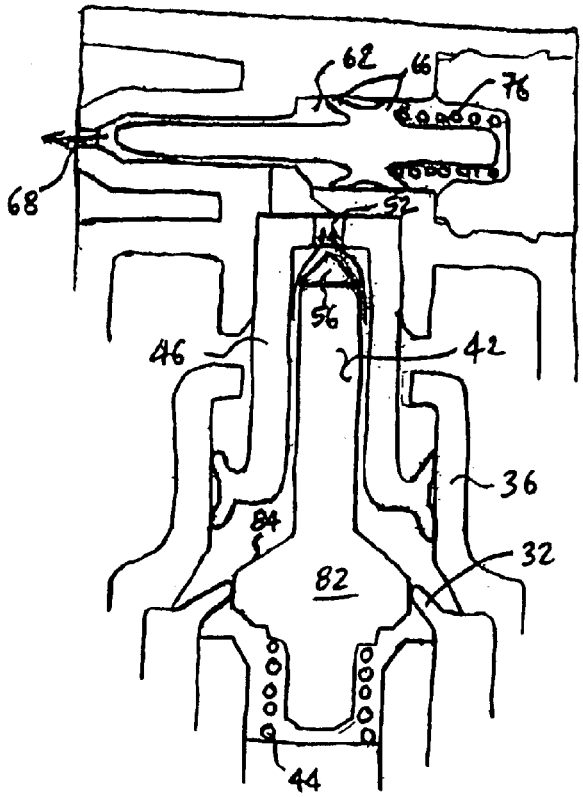
Figure 3:
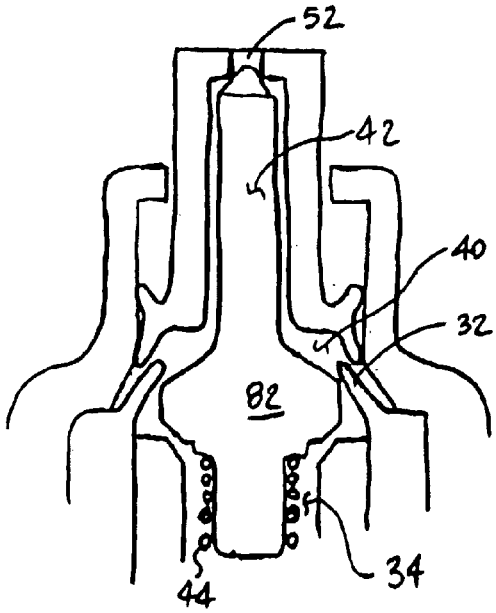

With reference to FIGS. 1–3, a first pump system 10 is shown in cross-section having an outer generally cylindrical wall 12. A bulkhead 14 extends inwardly from the wall 12 to define an upper limit of a reservoir 16. In a preferred embodiment, the reservoir 16 is not vented to atmosphere, and, thus, pressure piston 18 is provided to avoid the formation of a vacuum in the reservoir 16. The pressure piston 18 is urged towards the bulkhead 14 by spring 20 and is responsive to reductions of fluid volume in the reservoir 16 (such as with fluid being drawn therefrom). The spring 20 is mounted onto, and acts against an end plate 22, that is connected to the wall 12 using any technique known by those skilled in the art, such as with a snap fit. If required, and as will be recognized by those skilled in the art, venting may be provided between the wall 12 and the end plate 22, and may be provided similarly in the further embodiments described below.

Apertures 24 are defined through the bulkhead 14 through which fluid may be drawn from the reservoir 16. A solid disc-shaped support plate 26 is defined at the center of the bulkhead 14, with the apertures 24 being spaced circumferentially thereabout. Splines 28 extend upwardly from the support plate 26 and between the apertures 24, and a solid wall 30 encircles the splines 28. The wall 30 terminates in a cantilevered tapered seal ring 32. A lower pump chamber 34 is defined amidst the support plate 26, the wall 30, and the seal ring 32, which is in fluid communication with the reservoir 16 via the apertures 24.

Casing 36 is mounted onto the wall 30 and is formed with a cylindrical portion 37 and an upper aperture 38. An upper pump chamber 40 is defined within the casing 36 and is in communication with the lower pump chamber 34. A valve stem 42 is disposed within the pump chambers 34 and 40 and is urged away from the support plate 26 by a stem spring 44. A slidable piston cap 46 extends through the aperture 38 and has annular seal members 48 in sealing contact with the cylindrical portion 37 of the casing 36. The piston cap 46 further includes an inner annular passage 50 formed between the stem 42 and the piston cap 46 which is in fluid communication with an exit aperture 52 located at the upper extremity of the cap 46. The stem 42 is formed with a top 54 that terminates in a tapered portion 56 shaped to be seated in, and form a seal with, the exit aperture 52. The stem spring 44 is selected such that the tapered portion 56 is sufficiently acted on to form an acceptable seal with the exit aperture 52.

A nozzle actuator 58 is mounted onto the piston cap 46 so as to move unitarily therewith. Passageway 60 communicates the exit aperture 52 with a discharge chamber 62 in which is located a discharge piston 64. The discharge piston 64 includes circumferential seals 66 which prevent fluid from leaking beyond the discharge chamber 62. The discharge chamber 62 is in fluid communication with a discharge nozzle 68.

A stem 70 of the discharge piston 64 has a seal surface 72 formed at an end thereof which coacts with a tapered surface 74 of the actuator 58 to form a seal for the discharge chamber 62. A discharge spring 76 urges the seal surface 72 into engagement with the tapered surface 74. To facilitate assembly, an end 77 of the nozzle actuator 58 may be formed open so that the discharge piston 64 and the discharge spring 76 may be mounted therein and covered with a plug 78 which may be fixed using any technique known to those skilled in the art, such as with an interference fit using detents 80.

In use, the nozzle actuator 58 is caused to be pressed downwardly, as represented by the arrow A. As such, the piston cap 46 moves unitarily with the actuator 58, causing the top 54 to also move downwardly. Upon traversing a stroke distance S, an enlarged portion 82 of the top 54 engages the seal ring 32, thereby sealing the lower pump chamber 34 from the upper pump chamber 40. With further downward movement, the seal ring 32 is caused to flex outwardly (forming a seal with the enlarged portion 82) and the volume of the upper pump chamber 40 is decreased. With further volume decrease, the pressure of the fluid trapped within the upper pump chamber 40 increases and acts upon upper face 84 of the enlarged portion 82. As the actuator 58 and the piston cap 46 continue downwardly, pressure builds in the trapped fluid. When pressure overcomes the biasing force of the stem spring 44, the tapered portion 56 of the stem 42 moves downwardly and away from the cap 46, thereby exposing the exit aperture 52 (FIG. 2). Fluid then is forced into the discharge chamber 62 where pressure therein is increased until the seal members 66 are forced rearwardly against the force of the discharge spring 76. As a result, discharge nozzle 68 is exposed and pressurized fluid from the discharge chamber 62 is dispensed therefrom. When the enlarged portion 82 goes through, and beyond, the seal ring 32, the upper pump chamber 40 comes into fluid communication with the apertures 24 via the lower pump chamber 34, thereby reducing fluid pressure in the upper pump chamber 40 (FIG. 3). This allows the stem spring 44 to urge the stem 42 upwardly into sealing engagement with the exit aperture 52. With the exit aperture 52 closed, fluid pressure in the discharge chamber 62 decays with fluid being dispensed through the discharge nozzle 68, allowing the discharge spring 76 to shut off the discharge nozzle 68. The release of the actuator 58 allows the stem spring 44 to return the stem 42 and the piston cap 46 to their original rest positions. As the enlarged portion 82 passes upwardly through the seal ring 32, it creates a transient vacuum sufficient to draw a volume of fluid through the apertures 24 equal to the amount dispensed. The pressure piston 18 assists the transient vacuum in urging fluid into the lower pump chamber 34. This assures total fluid replacement. The volume of the reservoir 16 is decreased in response to the fluid which is drawn therefrom as the pressure piston 18 is pushed upwardly responsively by the spring 20.

The size of the dose dispensed by the pump system 10 is basically a function of four critical dimensions of the pump system 10. Particularly, the length of the enlarged portion 82 ("x"); the length of flat surface 83 of the seal ring 32 ("y"); the diameter of the enlarged portion 82 ("d"); and, the inner diameter of the casing 36 along cylindrical portion 37 ("z"). By minimizing the tolerances of these four dimensions, high-level of control over doses administered by the pump 10 can be achieved. As will be appreciated by those skilled in the art, dimension "y" (i.e., the flat surface 83) can be made so small (0.005 in) that dimensional variation may be practically zero and three dimensions actually control dosage of the pump system 10 (e.g., the flat surface 83 could be made as a small radius making this dimension a point contact with neglible width).

Figure 4:
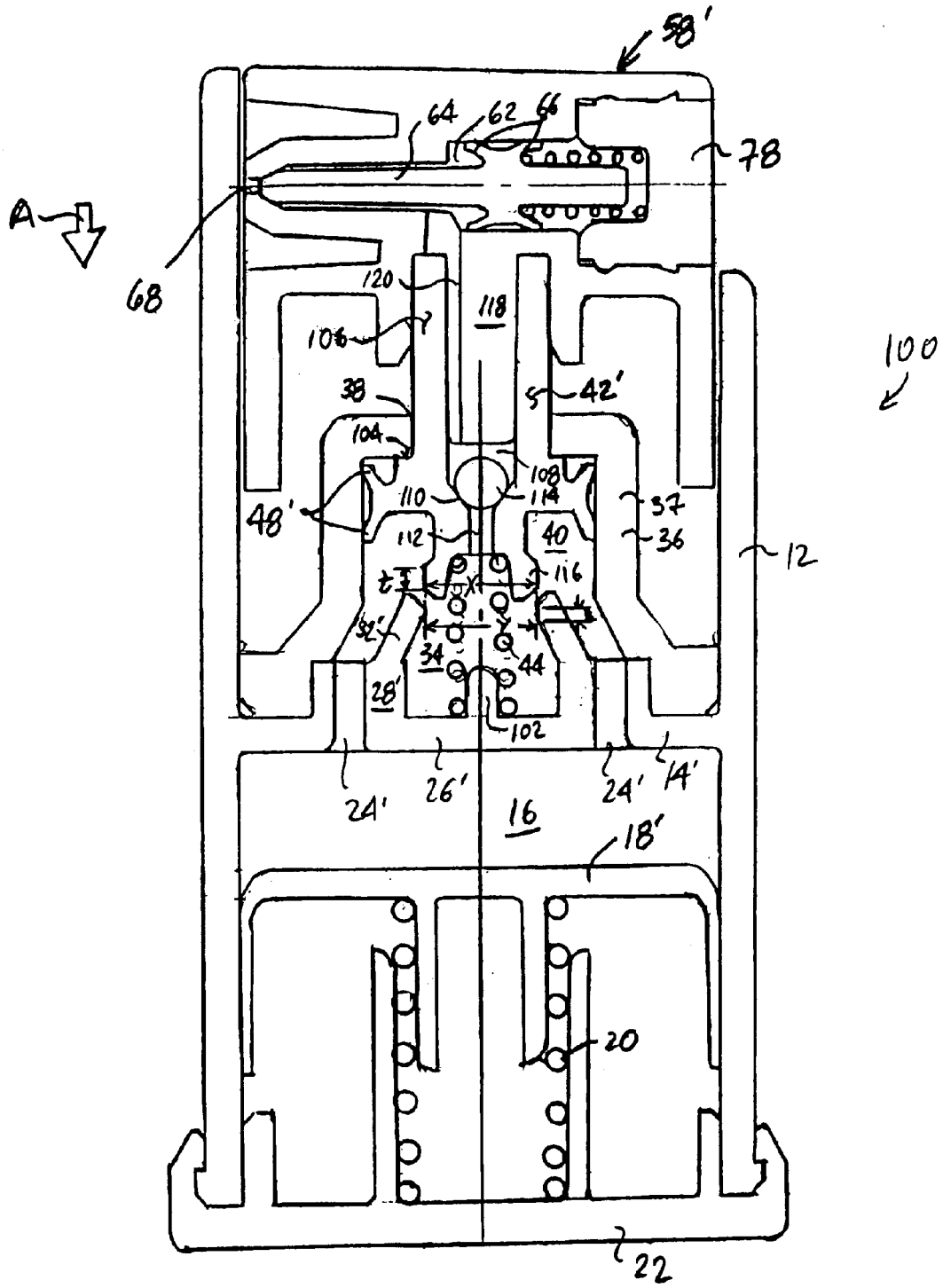
FIGS. 4–6 show a second embodiment of a pump system formed in accordance with the subject invention herein.
Figure 5:
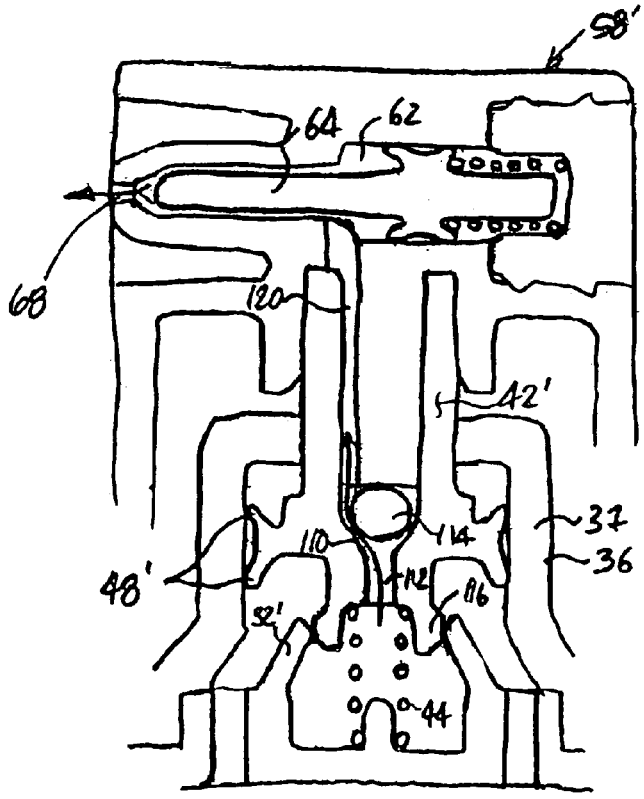
Figure 6:
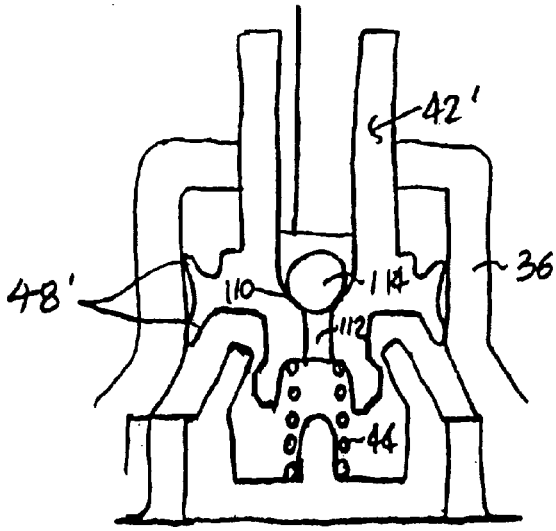

With reference to FIGS. 4–6, a second embodiment of a pump system is depicted therein in cross-section and generally designated with the reference numeral 100. Many of the components of the pump system 100 are the same as, or similar to, that of the pump system 10 described above, and are designated with like reference numerals herein. The pump system 100, like the pump system 10, is dependent upon four critical dimensions. The discussion below will focus on the differences from the pump system 10 in structure and operation.

A pressure piston 18' is provided which is spring-biased by a spring 20 in the same fashion as the pressure piston 18. However, the pressure piston 18' is shown to have a generally planar surface in contact with the reservoir 16, whereas the pressure piston 18 is formed with a tapered portion. The shape of the pressure piston 18, 18' is preferably selected to match the shape of the corresponding bulk head. In FIG. 1, the bulkhead 14 is formed with a tapered portion, whereas in FIG. 4, a bulkhead 14' is provided which is generally planar. In this manner, the pressure piston 18, 18' may efficiently urge fluid out of the reservoir 16.

A central disc-shaped support plate 26' is formed in the center of the bulkhead 14' with apertures 24' being formed circumferentially thereabout. An inner annular wall 28' extends from the support plate 26', located radially inwardly of the apertures 24'. The wall 28' terminates in a seal ring 32'. A locator pin 102 may also be provided which extends upwardly from the center of the support plate 26' to provide support for the spring 44. A lower pump chamber 34 is defined admist the support plate 26', the wall 28' and the seal ring 32'.

The pump system 100 utilizes a piston 42' which has a different configuration from the stem 42 of the first embodiment. The piston 42' is disposed to extend through an aperture 38 of casing 36 so as to be slidable relative thereto. Piston seals 48' provide a seal against the cylindrical portion 37 of the casing 36 during sliding movement of the piston 42'. The spring 44 urges the piston 42' upwardly and away from the support plate 26' with annular shoulder stop 104 defining the upper extent of movement of the piston 42' in contacting the casing 36. A cylindrical wall 106 extends upwardly from the shoulder stop 104 and through the aperture 38, and a central passageway 108 is defined within the wall 106. A check valve seat 10 is defined at an end of the passageway 108 which communicates with an inlet passageway 112. A check valve 114 is disposed in the passageway 108 so as to seat on the inlet check valve seat 110 and regulate flow through the inlet passageway 112. A lower annular piston ring 116 is defined about the inlet passageway 112. The piston ring 116 is formed to engage the seal ring 32' upon sufficient downward movement of the piston 42'.

A nozzle actuator 58' is rigidly fixed to the piston 42' so as to move unitarily therewith. The nozzle actuator 58' is generally the same as the nozzle actuator 58. The nozzle actuator 58' is mounted on the piston 42' in any manner so as to move unitarily therewith. In addition, an elongated block 118 is preferably provided which extends from the nozzle actuator 58' and into the passageway 108. In this manner, a reduced-diameter channel 120 is formed through the block 118 which communicates with passageway 60 and having a much smaller cross-section than the passageway 108.

In use, the nozzle actuator 58' is caused to translate downwardly (as shown by the arrow A), causing commensurate movement of the piston 42'. With sufficient movement, the piston ring 116 engages the seal ring 32' and causes the lower pump chamber 34 to be sealed from the upper pump chamber 40. With further downward movement of the piston 42', the seal ring 32' is caused to deflect outwardly, maintaining the seal between the pump chambers 34 and 40 intact. Further downward movement of the piston 42' causes volume reduction of the lower pump chamber 34, and an increase in pressure therein. With a sufficient increase in pressure, the check valve 114 is caused to lift from the valve seat 110 and pressurized fluid is forced through the inlet passageway 112, the channel 120 and the passageway 60 to act on the discharge piston 64 (FIG. 5). The fluid is discharged form the discharge chamber 62, in the same manner as described with respect to the pump system 10. When the piston ring 116 goes through, and beyond, the seal ring 32' (FIG. 6), pressure decays, the discharge piston 64 returns to its closed state, and the check valve 114 returns to its seated position on the valve seat 110. With release of the nozzle actuator 58', the spring 44 urges the piston 42', and the nozzle actuator 58', upwardly to the rest state shown in FIG. 4. As the piston 42' separates from the seal ring 32', fluid is drawn from the reservoir 16.

The four critical dimensions in the pump system 100 are the outer diameter x of the piston 42'; the diameter y of the seal ring 32'; the length t of the diameter x; and, the length z of flat surface 83' on the seal ring 32'. The "z" dimension can be a radius or a small flat (0.005 inches); as such, dimensional variation is practically zero making three dimensions control dosage.

Figure 7:
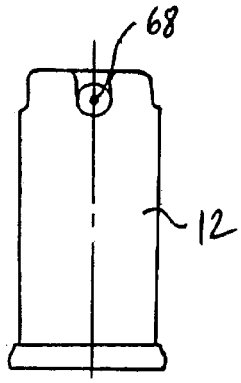
FIG. 7 is a front elevational view of a possible external configuration of a pump system.

With reference to FIG. 7, a possible external configuration of a pump system is shown, which may be either the pump system 10 or the pump system 100. Although the discharge nozzle 68 is shown to be covered in both FIGS. 1 and 4; it is in fact exposed, as shown in FIG. 7. It is critical that the nozzle 68 not be covered by the wall 12 at a location where fluid is to be discharged therefrom.

Figure 8:
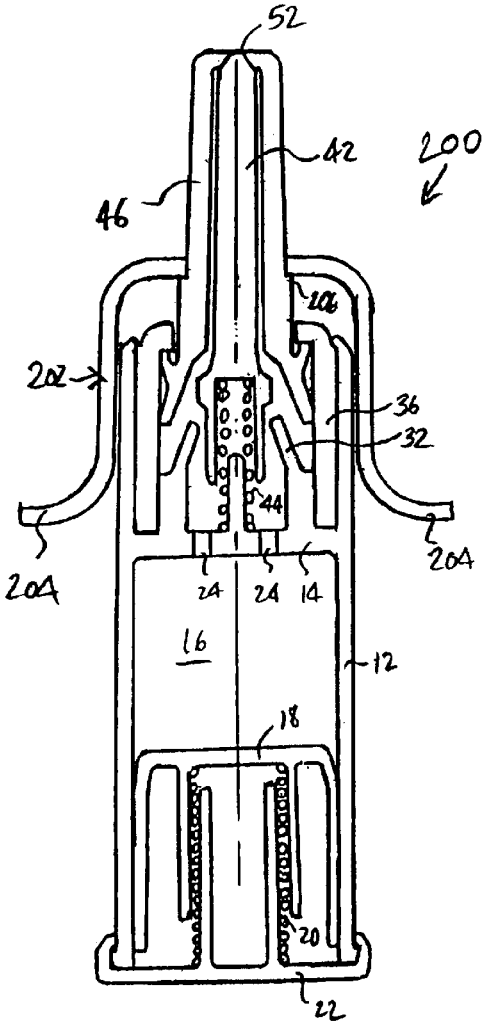
FIGS. 8–9 show a third embodiment of a pump system formed in accordance with the subject invention herein.
Figure 9:
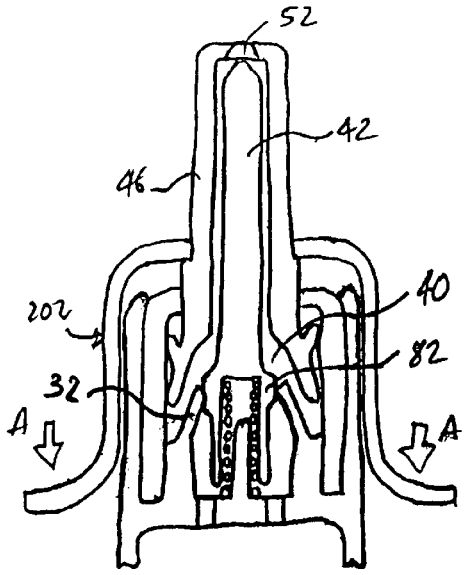

With reference to FIGS. 8–9, a third embodiment of a pump system is depicted therein in cross-section and generally designated with the reference numeral 200. The pump system 200 has the same basic structure and operates in the same basic manner as the first embodiment described above. However, the pump system 200 is an "in-line" dispenser having an exit aperture extending along the longitudinal axis of the pump system, such as in the manner of a nasal spray. Like reference numerals refer to identical or similar components described above.

The pump system 200 includes the exit aperture 52 formed in the piston cap 46 as with the first embodiment. However, the exit aperture 52 acts as a dispensing aperture for this embodiment in contrast to the first embodiment. Thus, fluid dispensed from the pump system 200 is dispensed along the longitudinal axis of the pump system 200 (which is coincident with the longitudinal axis of the stem 42 as shown in FIG. 8). To provide for actuation of the pump system 200, actuator 202 is provided having finger grips 204 formed to be depressed by the pointer and middle fingers of a user. The actuator 202 is rigidly mounted to the piston cap 46 about shoulder 206. With downward movement of the actuator 202, the pump system 200 works in the same manner as described above. For illustrative purposes, as shown in FIG. 9, with downward movement of the actuator 202, the stem 42 engages the seal ring 32 to form a seal therewith resulting in eventual separation of the stem 42 from the cap 46, with exposure of the exit aperture 52 for dispensing pressurized fluid from the upper pump chamber 40. Further downward movement of the actuator 202 results in pressure decay after a dose has been administered and full passage of the enlarged portion 82 beyond the seal ring 32 results in subsequent recharging of the pump system 200. A release of the actuator 202 allows for return of the valve stem 42 to its rest position as shown in FIG. 8.

Figure 10:
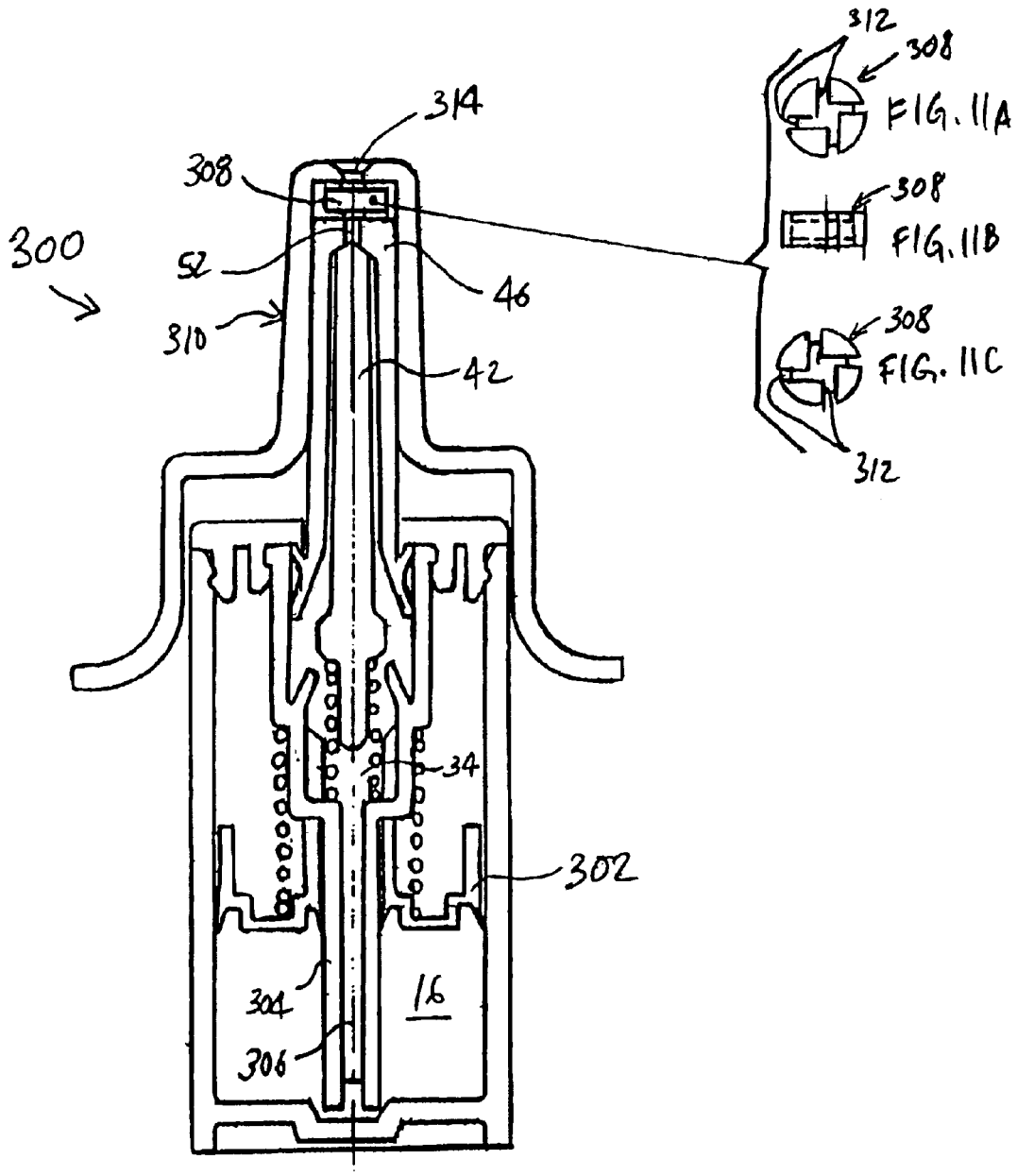
FIG. 10 shows a fourth embodiment of a pump system formed in accordance with the subject invention herein.

FIG. 10 shows a fourth embodiment of the subject invention which is a variation of the third embodiment. Pump system 300 is also an "in-line" pump system which utilizes valve stem 42, as in the first and third embodiments described above. Here, however pressure piston 302 applied to the reservoir 16 is applied in a downward motion to urge fluid up through tube 304, having a passage 306 formed therein, and into the lower pump chamber 34. Also, a swirl plug 308 may be provided between the piston cap 46 and actuator 310. Various swirl plug configurations are known in the prior art. As an exemplary embodiment, as shown in FIGS. 11A–11C, the spray plug 308 may include radiating channels 312. When fluid goes through the channels 312 and into the center of the plug 308, a swirling motion is imparted to the discharging fluid, causing the fluid to break up into a spray pattern through nozzle 314. In all other respects, the pump system 300 is essentially the same as the third embodiment.

As is readily apparent, numerous modifications and changes may readily occur to those skilled in the art, and hence it is not desired to limit the invention to the exact construction operation as shown and described, and accordingly, all suitable modification equivalents may be resorted to falling within the scope of the invention as claimed.

What is claimed is:

1. A pump system comprising:

a pump body having a first chamber defined therein;

a valve stem disposed to slide within at least a portion of said first chamber, said valve stem having a constant-diameter stroke portion interposed between reduced-diameter portions; and at least one stationary sealing member immovably affixed relative to said pump body, said at least one sealing member formed to sealingly engage said stroke portion of said valve stem, said at least one sealing member also formed to not engage said reduced-diameter portions, wherein in a rest position, said sealing member is not in sealing engagement with said stroke portion of said valve stem, wherein, over a predetermined extent of movement of said valve stem, said sealing member sealingly engages said stroke portion, and, wherein, upon movement of said valve stem beyond said predetermined extent of movement, said sealing member is not in sealing engagement with said stroke portion.

2. A pump system as in claim 1 further comprising a biasing means for urging said valve stem into said rest position.

3. A pump system as in claim 2 further comprising a piston disposed to sealingly engage a portion of said pump body, said piston including an exit aperture, said valve stem seating in said exit aperture in said rest position to seal or substantially seal said exit aperture.

4. A pump system as in claim 1, wherein, with said sealing member sealingly engaging said stroke portion, a first portion of said first chamber is isolated or substantially isolated from other portions of said first chamber.

5. A pump system as in claim 4 further comprising a piston disposed to reduce the enclosed volume of said first portion of said first chamber with said first portion being isolated or substantially isolated.

6. A pump system as in claim 5 further comprising an actuator rigidly mounted to said piston.

7. A pump system as in claim 6, wherein said actuator includes a nozzle.

8. A pump system as in claim 7, wherein said nozzle is aligned to dispense fluid transversely to a longitudinal axis of said valve stem.

9. A pump system as in claim 7, wherein said nozzle is aligned to dispense fluid along a longitudinal axis of said valve stem.

10. A pump system comprising:

a pump body having a first chamber defined therein;

a piston disposed to slide within at least a portion of said first chamber, said piston sealingly engaging a portion of said pump body, said piston having a constant-diameter stroke portion interposed between reduced-diameter portions; and at least one stationary sealing member immovably affixed to said pump body, said at least one sealing member formed to sealingly engage said stroke portion of said piston, said at least one sealing member also formed to not sealingly engage said reduced-diameter portions, wherein in a rest position, said sealing member is not in sealing engagement with said stroke portion of said piston, wherein, over a predetermined extent of movement of said piston, said sealing member sealingly engages said stroke portion, and wherein, upon movement of said piston beyond said predetermined extent of movement, said sealing member is not in sealing engagement with said stroke portion.

11. A pump system as in claim 10 further comprising a biasing means for urging said piston into said rest position.

12. A pump system as in claim 10, wherein, with said at least one sealing member sealingly engaging said stroke portion, a first portion of said first chamber is isolated or substantially isolated from other portions of said first chamber.

13. A pump system as in claim 12, wherein said piston is formed to reduce the enclosed volume of said first portion of said first chamber with said first portion being isolated or substantially isolated.

14. A pump system as in claim 10, wherein a passageway is defined through said piston.

15. A pump system as in claim 14 further comprising an inlet check valve disposed in said passage.

16. A pump system as in claim 10 further comprising an actuator mounted to said piston.

* * * * *